US007846114B2

(12) United States Patent
Webster et al.

(10) Patent No.: US 7,846,114 B2
(45) Date of Patent: Dec. 7, 2010

(54) COMPRESSION DEVICE

(75) Inventors: Nathan Webster, South Glamorgan (GB); Anne Somerville, Long Marston (GB)

(73) Assignee: Huntleigh Technology Limited (GB)

( * ) Notice: Subject to any disclaimer, the term of this patent is extended or adjusted under 35 U.S.C. 154(b) by 895 days.

(21) Appl. No.: 11/573,101

(22) PCT Filed: Aug. 4, 2005

(86) PCT No.: PCT/GB2005/003063

§ 371 (c)(1),
(2), (4) Date: Mar. 20, 2007

(87) PCT Pub. No.: WO2006/013375

PCT Pub. Date: Feb. 9, 2006

(65) Prior Publication Data

US 2008/0097264 A1 Apr. 24, 2008

(30) Foreign Application Priority Data

Aug. 4, 2004 (GB) ..... 0417335.7

(51) Int. Cl.
*A61H 7/00* (2006.01)
*A61H 19/00* (2006.01)

(52) U.S. Cl. ..... 601/152

(58) Field of Classification Search ..... 601/148–152; 602/13

See application file for complete search history.

(56) References Cited

U.S. PATENT DOCUMENTS

| | | | | |
|---|---|---|---|---|
| 4,453,538 | A | 6/1984 | Whitney et al. | |
| 4,865,020 | A | 9/1989 | Bullard et al. | |
| 5,263,473 | A * | 11/1993 | McWhorter | 601/152 |
| 5,496,262 | A * | 3/1996 | Johnson et al. | 601/152 |
| 5,795,312 | A * | 8/1998 | Dye | 601/151 |
| 5,951,502 | A | 9/1999 | Peeler et al. | |
| 5,968,073 | A * | 10/1999 | Jacobs | 606/202 |
| 6,558,338 | B1 * | 5/2003 | Wasserman | 601/152 |
| 6,966,884 | B2 * | 11/2005 | Waldridge et al. | 601/152 |
| 7,063,676 | B2 * | 6/2006 | Barak et al. | 601/150 |

* cited by examiner

*Primary Examiner*—Tatyana Zalukaeva
*Assistant Examiner*—Kristen C Matter
(74) *Attorney, Agent, or Firm*—Craig A. Fieschko, Esq.; DeWitt Ross & Stevens S.C.

(57) ABSTRACT

A compression sleeve (10) has twelve inflatable cells (13) to be wrapped around a limb. The cells (13) are inflated to set pressures and duration by a fluid source. The cells (13) are numbered (1) to (12), with (1) being at the toe, or the wrist, and (12) being at the thigh, or the shoulder. In use, the inflation sequence begins with a peristaltic wave at cell (1) and finishes at cell (12). Then cell (12) is inflated and deflated 5 times, then cell (11) is inflated and deflated 5 times in the same way as cell (12), followed by a single peristaltic wave beginning at cell (12) to cell (11). This compression regime is repeated along the compression sleeve until cell (1) is inflated and deflated (5) times followed by a peristaltic wave from cell (1) to cell (12). The described compression sequence is particularly useful for lymphatic drainage.

25 Claims, 2 Drawing Sheets

COMPRESSION DEVICE

FIELD OF THE INVENTION

The present invention relates to a device for applying intermittent compression to a body part or limb, in particular compression sleeves for treating edema, lymphoedema, lipodema or similar.

BACKGROUND OF THE INVENTION

A known apparatus for applying intermittent compression includes a sleeve with a plurality of cells having inflatable bladders and control means to pressurise the bladders in variable sequences.

These existing compression systems apply various inflation-deflation sequences and different pressures in a plurality of adjacent cells to obtain pressure gradients with the purpose to move or "squeeze" bodily fluids from the tissues into the lymphatic and venous systems. However, these traditional Intermittent Pneumatic Compression (IPC) systems using sequential or wave modes of inflation are thought to promote fluid transfer while having little effect on the larger protein molecules that need to be removed from the oedematous tissues.

A known therapy, Manual Lymphatic Drainage (MLD), aims to move both these larger protein molecules and fluid from the tissues into the lymphatic system. The sequence and direction of the MLD massage is designed to stimulate lymphatic flow and drainage away from the congested areas. MLD promotes the removal of fluids and protein molecules from the tissues by working the muscles around the lymphatic system and opening any blockages within the lymphatic channels. The MLD therapist works on the affected body part or limb initially at the top (proximal) then works down the limb (distal) but the compression or massaging movements are in a distal to proximal direction. Once the lymphatic channels are opened up, the full limb is massaged in a distal to proximal direction. MLD is usually administered by hand, and the invention seeks to provide effective lymphatic drainage of fluid and proteins from oedematous tissues.

SUMMARY OF THE INVENTION

Accordingly, the present invention provides a compression sleeve applying intermittent compression to a body part or limb, the compression sleeve having a plurality of cells located longitudinally along the sleeve and control means controlling a fluid source to inflate and deflate the cells to selected pressure arrangements and duration, wherein the control means inflates the most distal cell on the body part or limb to a set pressure and continues to inflate each adjacent cell in sequence in a distal to proximal direction to provide a peristaltic wave, at the end of the wave inflation at the most proximal cell, that proximal cell is inflated and deflated a prearranged number of times and duration, and each adjacent cell inflated and deflated in the prearranged number of times and duration in sequence in a proximal to distal direction to the most distal cell.

The apparatus of the present invention is particularly beneficial in applying intermittent compression to oedematous tissues as it enables the opening up of the lymphatic system to allow the absorption of protein molecules from the surrounding tissues. The existing sequential compression in distal to promixal direction in sequence or waves is ineffective as waste fluids come up against the blockages further up the limb and cannot be moved out of the limb.

Preferably, each cell is inflated and deflated five times, and more preferably each inflation is between 3 to 5 seconds duration followed by deflation between 1 to 3 seconds. In order to promote reabsorption of protein molecules from the surrounding tissues into the lymphatic or venous systems, MLD researchers have shown that a number of repeated movements are required to open the lymphatic channels and ensure that the protein molecules are taken into the lymphatic system.

Preferably, each number of repeated inflation and deflation of the cell is followed by a single peristaltic wave back to the preceding cell, helping to move the lymph fluid up the body part or limb towards the torso.

A preferred embodiment of the invention comprises a compression sleeve with twelve cells along its length.

BRIEF DESCRIPTION OF THE DRAWINGS

The invention will now be described, by way of example only, with reference to the accompanying drawings in which.

DETAILED DESCRIPTION OF PREFERRED VERSIONS OF THE INVENTION

Figure 1:
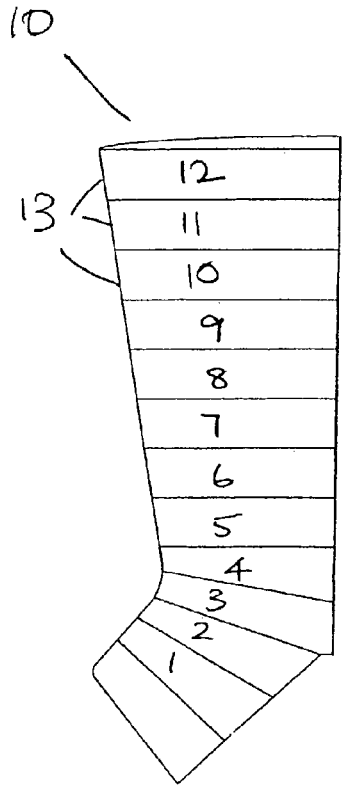
FIG. 1 is a schematic layout of a compression sleeve, according a preferred embodiment of the present invention.

With reference to FIG. 1, a preferred embodiment of the present invention comprises a compression sleeve 10 with a plurality of inflatable cells 13. The construction of the sleeve and cells can be of known conventional construction or can be as described in our co-pending GB 0424562.7 herein incorporated by reference. The cells are inflated by means of pressurised fluid from a fluid source controlled by electronic control (not shown). The fluid source and control can be of conventional type or as described in our co-pending application GB 0424870.4 herein incorporated by reference. The compression sleeve 10 and inflatable cells 13 are of an annular shape and are adapted to be wrapped around the human body part or limb thereof and fixed thereto. In the specific embodiment as shown in FIG. 1 the compression sleeve 10 comprises twelve cells 13.

The cells 13 along the compression sleeve are numbered 1 to 12, with 1 being at the toe, or the wrist, and 12 being at the thigh, or the shoulder. The lymphatic drainage compression sequence according to the invention commences at cell 12, with the user setting the appropriate pressure and duration to be delivered to the sleeve, and the overall treatment time for the sequence.

Figure 2:
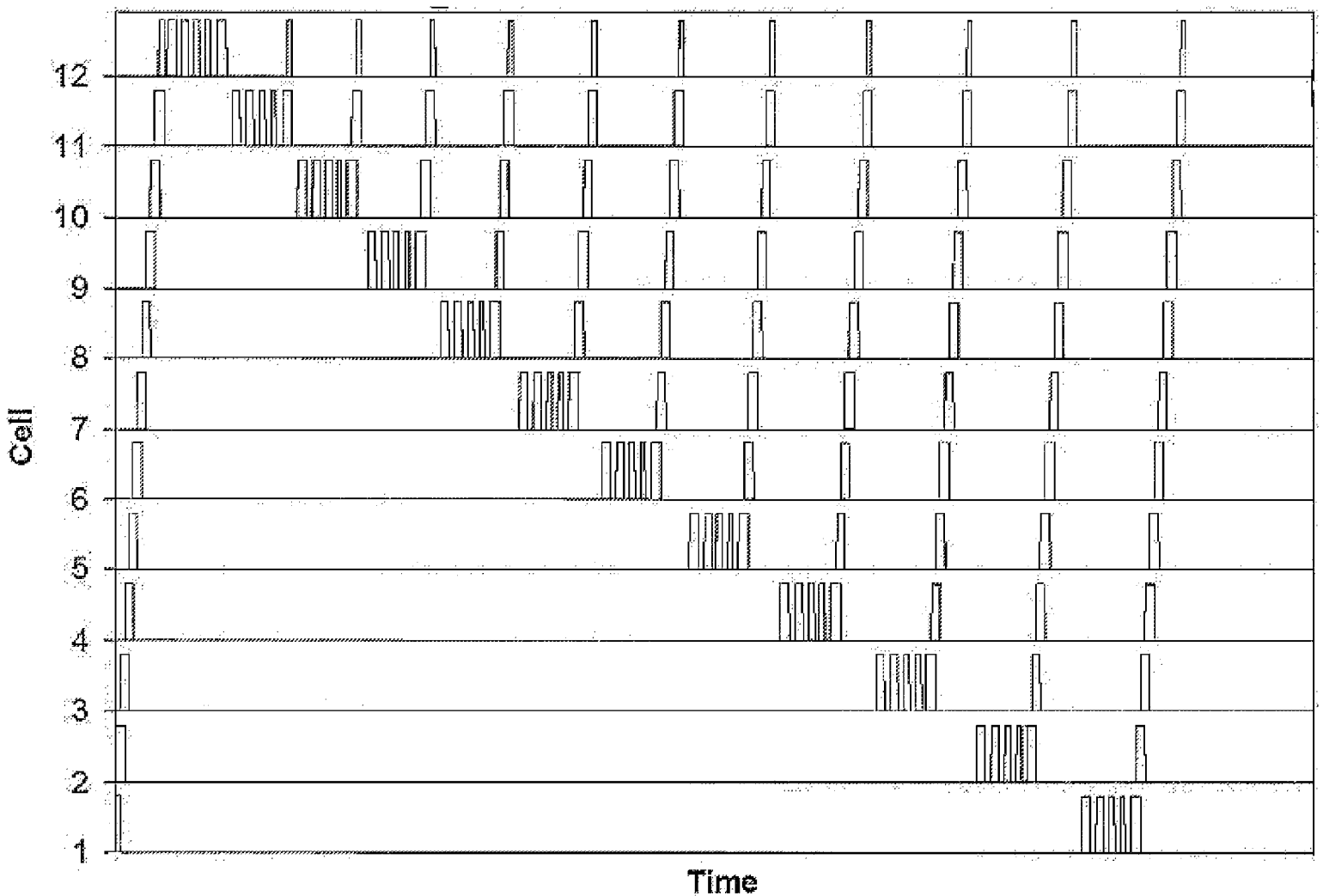
FIG. 2 is a graph showing the lymph drainage compression sequence of the present invention.

In use, the sequence begins with a standard peristaltic wave where the inflation wave begins at cell 1 and finishes at cell 12. This wave of inflation has a 60% pressure gradient such that cell 1 inflates at the pressure set on the pump and the pressure at cell 12 is 60% less than the pressure at cell 1. At the end of the wave inflation at cell 12, cell 12 is inflated and deflated 5 times, each inflation being of between 3 to 5 seconds duration followed by deflation of between 1 to 3 seconds as seen in FIG. 2. After 3 seconds, the next cell 11 is inflated and deflated 5 times in the same way as cell 12, followed by a single peristaltic wave beginning at cell 12 to cell 11. After 3 seconds, cell 10 is inflated and deflated 5 times as before with cells 12 and 11 again followed by a single peristaltic wave beginning at cell 11 to cell 12. This compression regime is repeated along the compression sleeve until cell 1 is inflated and deflated 5 times followed by a peristaltic wave from cell 1 to cell 12. The lymphatic drainage compression sequence can be repeated if required by the repeat inflation and deflation of cell 12 five times, and so on. When the set treatment time for the user has elapsed, the treatment is terminated by a peristaltic wave beginning at cell 1 and finishing at cell 12.

The above treatment as performed within the lymphatic drainage compression sequence works by promoting the reabsorption of protein molecules from the surrounding tissue into the lymphatic and venous systems facilitating drainage of fluids and proteins away from these tissues.

The described compression sequence is particularly useful for lymphatic drainage and has proved far more effective than the conventional distal to proximal sequential therapy, wave therapy or peristaltic wave therapy.

The system according to the invention allows the user to receive the correct lymphatic drainage compression therapy at home without the presence of an MLD nurse, thereby reducing the demand on MLD nurses, or the need for patients to attend MLD clinics.

The invention claimed is:

1. A compression sleeve applying intermittent compression to a body part or limb, the compression sleeve having a plurality of cells located longitudinally along the sleeve from a proximal cell to a distal cell, and control means controlling a fluid source to inflate and deflate the cells to selected pressure arrangements and duration, wherein the control means inflates, in order:

a. the most distal cell on the body part or limb, b. each adjacent cell in sequence in a distal to proximal direction, c. the most proximal cell, wherein the most proximal cell is inflated several times in series; and d. each adjacent cell in sequence in a proximal to distal direction, wherein each cell is inflated several times in series, and deflated, before a distally adjacent cell is inflated.

2. A compression sleeve as claimed in claim 1 wherein during sequential inflation of each adjacent cell in sequence in a proximal to distal direction, each cell is inflated and deflated five times.

3. A compression sleeve as claimed in claim 2 wherein each inflation is:

a. between 3 to 5 seconds duration, followed by b. deflation of between 1 to 3 seconds.

4. A compression sleeve as claimed in claim 1 wherein during sequential inflation of each adjacent cell in sequence in a proximal to distal direction, each inflation of the cell is followed by a single peristaltic wave back to the preceding cell.

5. A method of applying intermittent compression to a body part or limb with a compression sleeve, the compression sleeve including inflatable cells arrayed longitudinally along the sleeve from a proximal cell to a distal cell, the method comprising the steps of inflating, in order:

a. the most distal cell on the body part or limb;

b. each proximally adjacent cell in sequence in a distal to proximal direction;

c. the most proximal cell, wherein the most proximal cell is inflated several times in series; and d. each distally adjacent cell in sequence in a proximal to distal direction, with each distally adjacent cell being inflated only after deflation of any proximally adjacent cell.

6. The method of claim 5 wherein during the step of inflating each distally adjacent cell in sequence in a proximal to distal direction, each cell is inflated several times in series.

7. The method of claim 6 wherein during the step of inflating each distally adjacent cell in sequence in a proximal to distal direction, each cell is inflated five times in series.

8. The method of claim 6 wherein during the inflation of each cell several times in series, each cell is inflated for:

a. a duration of 3 to 5 seconds, followed by b. a deflation of between 1 to 3 seconds.

9. The method of claim 6 wherein during the inflation of each cell several times in series, each proximally adjacent cell is also inflated in sequence in a distal to proximal direction.

10. The method of claim 9 wherein during the step of inflating each proximally adjacent cell in sequence in a distal to proximal direction, the start of each proximally adjacent cell's inflation occurs at a time prior to the end of the prior proximally adjacent cell's inflation.

11. The method of claim 5 wherein during the step of inflating each proximally adjacent cell in sequence in a distal to proximal direction to the most proximal cell, each cell is inflated for a period which only partially overlaps the inflation period of adjacent cells.

12. The method of claim 11 wherein during the step of inflating each proximally adjacent cell in sequence in a proximal to distal direction, each cell is inflated several times in series.

13. The method of claim 12 wherein during the inflation of each cell several times in series, each proximally adjacent cell is also inflated in sequence in a distal to proximal direction.

14. A method of applying intermittent compression to a body part or limb with a compression sleeve, the compression sleeve including inflatable cells arrayed along the sleeve from a proximal cell to a distal cell, the method including:

a. applying an initial distal-to-proximal sequence of inflation pulses to the cells, wherein each inflation pulse:

(1) begins during the inflation pulse of any distally adjacent cell, and (2) ends during the inflation pulse of any proximally adjacent cell, b. then applying a proximal-to-distal sequence of spaced inflation pulses to the cells, wherein each cell receives a series of successive pulses before a distally adjacent cell is pulsed.

15. The method of claim 14 wherein after each cell receives its series of successive pulses, the cell's proximally adjacent cells receive a subsequent distal-to-proximal sequence of inflation pulses.

16. The method of claim 15 wherein each inflation pulse in the subsequent distal-to-proximal sequence overlaps in duration with the inflation pulse of the distally adjacent cell.

17. The method of claim 15 wherein each inflation pulse in the subsequent distal-to-proximal sequence:

a. begins during the inflation pulse of any distally adjacent cell, and b. ends during the inflation pulse of any proximally adjacent cell.

18. The method of claim 14 wherein all inflation pulses have at least substantially equal duration.

19. The method of claim 14 wherein the inflation pulse delivered to each cell:

a. has a duration of 5 seconds or less, and b. is spaced by 1 second or more from any subsequent inflation pulses delivered to the same cell.

20. A method of applying intermittent compression to a body part or limb with a compression sleeve, the compression sleeve including inflatable cells arrayed along the sleeve from a proximal cell to a distal cell, the method including applying a proximal-to-distal sequence of inflation pulses to the cells wherein:

a. each cell receives a series of successive pulses, and b. after the cell receives the series of successive pulses, the cell's proximally adjacent cells receive a subsequent distal-to-proximal sequence of inflation pulses, before any distally adjacent cell within the proximal-to-distal sequence is pulsed.

21. The method of claim 20 further including the step, prior to applying the proximal-to-distal sequence of inflation pulses to the cells, of applying an initial distal-to-proximal sequence of inflation pulses to the cells.

22. The method of claim 21 wherein each inflation pulse in each distal-to-proximal sequence of inflation pulses overlaps in duration with the inflation pulse of the distally adjacent cell.

23. The method of claim 21 wherein each inflation pulse in each distal-to-proximal sequence of inflation pulses:

a. begins during the inflation pulse of any distally adjacent cell, and b. ends during the inflation pulse of any proximally adjacent cell.

24. The method of claim 20 wherein all inflation pulses have at least substantially equal duration.

25. The method of claim 20 wherein each inflation pulse:

a. has a duration of 5 seconds or less, and b. is spaced by 1 second or more from any subsequent inflation pulses delivered to the same cell.

* * * * *